US005671940A

United States Patent [19]

Abondance

[11] Patent Number: 5,671,940

[45] Date of Patent: Sep. 30, 1997

[54] DEVICE FOR MOUNTING A BOOT ON A DOWNHILL SKI

[75] Inventor: Roger Abondance, La Murette, France

[73] Assignee: Skis Rossignol S.A., Voiron, France

[21] Appl. No.: 784,297

[22] Filed: Jan. 16, 1997

Related U.S. Application Data

[63] Continuation of Ser. No. 154,530, Nov. 19, 1993, abandoned.

[30] Foreign Application Priority Data

Nov. 19, 1992 [FR] France ..... 92 14128

[51] Int. Cl.[6] ..... A63C 5/075

[52] U.S. Cl. ..... 280/602; 280/607

[58] Field of Search ..... 280/602, 607

[56] References Cited

U.S. PATENT DOCUMENTS

| | | | |
|---|---|---|---|
| 3,260,532 | 7/1966 | Heuvel | 280/602 |
| 3,797,839 | 3/1974 | Smolka et al. | 280/607 X |
| 3,797,844 | 3/1974 | Smolka et al. | 280/607 X |
| 4,627,635 | 12/1986 | Koleda . | |
| 4,896,895 | 1/1990 | Bettosini | 280/607 |
| 4,995,630 | 2/1991 | Piegay | 280/602 |
| 5,026,086 | 6/1991 | Guers et al. | 280/607 |
| 5,143,395 | 9/1992 | Mayr . | |
| 5,199,734 | 4/1993 | Mayr . | |
| 5,342,077 | 8/1994 | Abondance | 280/602 |

FOREIGN PATENT DOCUMENTS

| | | | |
|---|---|---|---|
| 176165 | 9/1953 | Austria | 280/602 |
| 454655 A1 | 10/1991 | European Pat. Off. . | |
| 490044 A1 | 6/1992 | European Pat. Off. . | |
| 2476495 | 8/1981 | France . | |
| 2575393 | 7/1986 | France . | |
| 2643431 | 4/1990 | France . | |
| 2637192 | 4/1990 | France . | |
| 2638651 | 5/1990 | France . | |
| 674155 A5 | 5/1990 | France . | |
| 2664823 | 1/1992 | France . | |
| 3710092 A1 | 10/1988 | Germany . | |
| 4038824 A1 | 6/1992 | Germany . | |
| 83 03360 | 10/1983 | WIPO . | |
| 85 01220 | 3/1985 | WIPO . | |

*Primary Examiner*—Kevin Hurley
*Attorney, Agent, or Firm*—Oliff & Berridge

[57] ABSTRACT

A device used to mount bindings on a ski has a plate made of viscoelastic material, one of whose faces is joined with the upper surface of the ski and the other of whose faces is joined with a rigid plate on which the bindings can be mounted. The plate of viscoelastic material is not attached in a potion of its surface to the upper surface of the ski and/or the lower surface of the rigid plate. Plates may be provided which have in a central area at least one predeformation oriented in a direction opposite the ski.

28 Claims, 3 Drawing Sheets

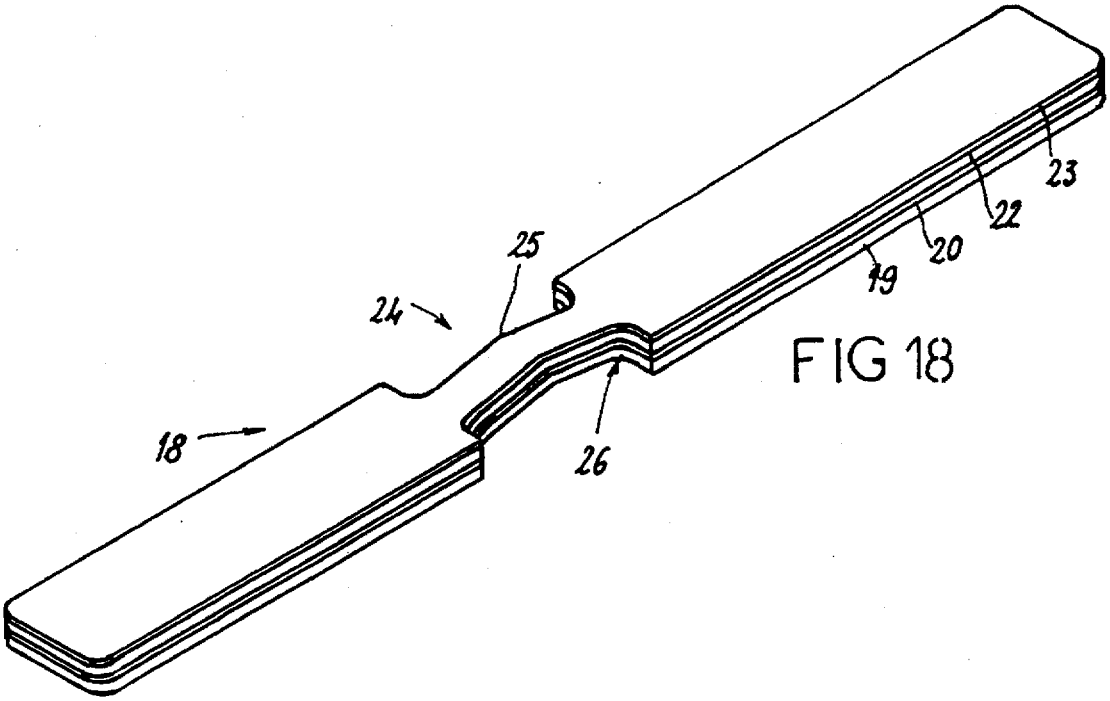
FIG 18
FIG 19
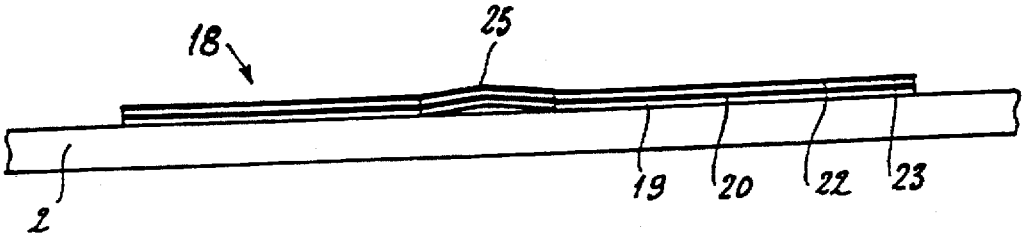
FIG 20
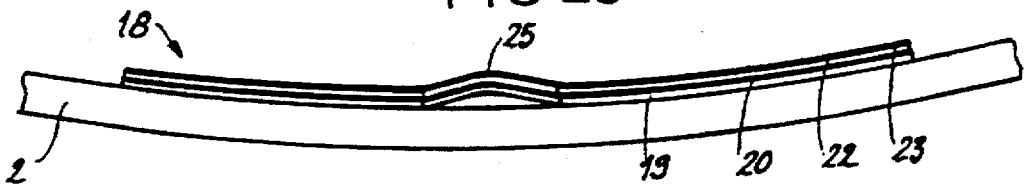
FIG 21
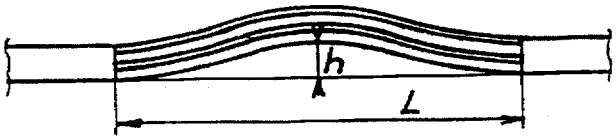

DEVICE FOR MOUNTING A BOOT ON A DOWNHILL SKI

This is a Continuation of application Ser. No. 08/154,530 filed Nov. 19, 1993 now abandoned.

FIELD OF THE INVENTION

The invention relates to a device for mounting a boot on a downhill ski.

BACKGROUND OF THE INVENTION

Traditionally a boot is attached to a ski by a toe binding and a heel binding mounted by being screwed to the body of the ski, between which the boot is elastically pinched. Numerous studies in the area of design and construction of skis are aimed at improving the conditions for guiding the mount of a boot on a ski.

It has been found in the case of skis of limited width in the central zone that when edging the ski on a steep slope the boot could engage the snow, resulting in the skier losing his balance. It is therefore known to raise the boot relative to the upper surface of the ski to prevent or restrict the boot from engaging the snow when an edge is engaged. One solution includes mounting the ski binding, i.e., the toe binding and heel binding, on wedges elevated relative to an upper surface of the ski.

Patent DE 3,710,092 describes a device of this type in which two wedges are connected by a plate. In this device the plate is designed to prevent the longitudinal thrusting force of the bindings (toe and heel) on the boot, from changing the camber of the ski. On the other hand, this plate has a harmful effect since it has a tendency to stiffen the ski in the central zone.

To improve the user's comfort while optimizing the precision of the ski when making turns, viscoelastic materials have been used. The viscoelastic materials are located either inside the ski or on the surface thereof in locations that are carefully defined to effectively prevent certain ranges of harmful vibrations as described in French patents 2,476,495 and 2,575,393.

Attempts have been made to mount the bindings on a plate which is itself damped relative to the ski. Document W083/03360 describes a plate with bindings mounted in parallel with the ski at a distance from the ski and attached to the ski by the ends of the plate, with interposition of a damping material between the plate and the ski.

French Patent 2,637,192 describes a ski wherein the bindings are mounted on a rigid plate, which is mounted on a plate made of viscoelastic material integral with the upper surface of the ski.

French Patent 2,638,651 relates to a device comprising a layer of viscoelastic material mounted on the upper surface of the ski, in turn covered by a rigid plate that serves to mount the bindings.

French Patent 2,664,823 relates to a device comprising, in the area of the central zone of the ski, a first layer of viscoelastic material attached to the upper surface of the ski, on the upper surface of which is mounted a plate made of rigid material itself covered by a second layer of viscoelastic material, with the second layer of viscoelastic material possibly being covered by a second rigid plate on which the binding is mounted. The first plate of viscoelastic material mounted on the ski works in shear and damps the vibrations while the second plate of viscoelastic material modulates the traction-compression forces, the torsional moments, and the lateral deformations, thus acting to limit the deformations, improving the skier's comfort.

The latter solutions presented are effective on straight runs or on large radius turns, which is well-suited for downhill or giant slalom trials. In contrast, these devices are harmful to the behavior of the ski on fast turns with small radii. Skis used for this specialty must cut, in other words they must be lively and relatively more flexible, especially in the central zone, than skis for large radii turns. In addition to these qualities it is important to preserve the qualities already identified namely, damping of vibrations, elevation of the boot, looseness of the ski relative to the bindings.

SUMMARY OF THE INVENTION

A goal of the invention is to provide a device for mounting a boot on a downhill ski permitting elevation of the boot relative to the upper surface of the ski, ensuring damping of vibrations and damping of impacts by a crushing effect, while making the ski as nonrigid as possible in the central zone in order to provide flexibility favorable to making small radii turns, similar to turns made by skis used, for example, in special slalom.

In accordance with the invention, the ski includes in the central zone and extending over a length close to the length required for mounting the bindings and the boot itself, a plate of viscoelastic material integrated with the body of the ski by one of the faces of the plate and attached by the other face of the plate to a constraining plate on which the binding is mounted. The plate of viscoelastic material is not attached by the plate's entire surface to the upper surface of the ski and/or the lower surface of the rigid constraining plate which is made in one or several sections.

The absence of mounting the plate of viscoelastic material over the entire surface on the upper surface of the ski or on the constraining plate can be obtained either by not gluing the plate of viscoelastic material over the entire surface on the ski and/or on the constraining plate or by using a plate of viscoelastic material with a larger surface area than the constraining plate.

BRIEF DESCRIPTION OF THE DRAWINGS

The following description refers to the drawings attached, which show nonlimiting examples of several embodiments of this device:

FIG. 18 is a perspective view on an enlarged scale of another embodiment of the device;

FIGS. 19 and 20 are two side views of the central part of a ski equipped with the device of FIG. 18, when the ski is at rest and when the ski is arched under utilization conditions, respectively;

FIG. 21 is a side view on an enlarged scale of the predeformed area of the device of FIG. 18.

DETAILED DESCRIPTION OF EMBODIMENTS

Figure 1:
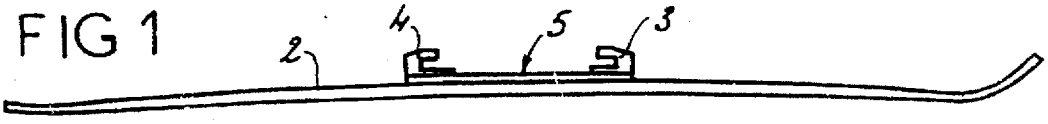
FIG. 1 is a side view of a device for mounting a boot on a ski, according to the invention.

According to one embodiment of the invention, the viscoelastic material plate is mounted on the ski only in the two end areas, over a length corresponding essentially to that of the base of the bindings, which includes the heel binding and toe binding.

Accordingly, the ski is more flexible than if the plate of viscoelastic material were glued over the entire surface of the ski. The relative flexibility of the central zone obtained in accordance with the one embodiment allows the ski to become rounded during the turn, which permits the edges to define a clean curve without skidding. On the other hand, the efficiency of the damping is significantly reduced, leading to an improvement in the liveliness of the ski especially since the plate has a tendency to buckle during bending of the ski, favoring the return of the ski to the ski's original position under a spring action. The ski is therefore sufficiently lively so that after coming out of a turn the ski can resume its initial shape to begin the next turn on the other side of the ski, in other words on the other reference line.

According to another embodiment of the invention, the plate of viscoelastic material is attached to the ski in the central area only, in other words on the length between the rear of the toe stop and the front of the heel stop.

In this embodiment, since the entire mounting device is only attached in its central part to the ski, the ski is very loose or flexible and can therefore play or flex more freely, which improves the ski's characteristics, especially on small radius turns. In this embodiment the damping effect is further reduced, thus improving the liveliness of the ski.

According to another embodiment of the invention, the top of the constraining plate is attached to the plate of viscoelastic material only in the constraining plate's two end areas and over a length that essentially corresponds to that of the base of the ski bindings, which includes both the toe binding and the heel binding. This embodiment reduces the shear in the plate of viscoelastic material, which translates into a reduction of the damping but also into an improvement of the liveliness of the ski. This embodiment is favorable for the looseness or flexibility of the ski since the constraining plate offers less resistance when flexing.

Another embodiment includes the constraining plate being more complex, for example, made up of a stack of rigid plates acting in combination as a constraining plate proper, and made of a material such as, for example, a light metal alloy. The constraining plate proper is covered by a plate of viscoelastic material, which is covered by a second rigid plate. Further, in accordance with this embodiment, the first rigid plate called the constraining plate can also be made in several sections staggered lengthwise relative to one another. Accordingly, the various sections of the constraining plate can be separated from the adjacent sections by a straight slot perpendicular to a lengthwise axis of the ski or by a slanting slot, a curved slot, or a slot that forms a broken line.

According to one embodiment, the lower constraining plate has a length which is less than that of the viscoelastic material plate.

According to another embodiment, the constraining plate is in the form of two sections located in front and rear areas of the plate of viscoelastic material.

In the two embodiments described above, the two plates of viscoelastic material are glued directly on top of one another in areas that are not covered by the first rigid plate.

In accordance with another embodiment of the invention, a different behavior of the ski on the inner edge and on the outer edge is obtained by the mounting areas of the plate of viscoelastic material on the upper surface of the ski or on the constraining plate and are asymmetrical relative to the lengthwise median plane of the ski. Similarly, the constraining plate is made in several sections separated from one another by slots which are not symmetrical relative to the lengthwise plane of the ski.

Another embodiment in accordance with the invention has recesses in the central area of the ski.

This provides a looseness of the ski in lateral flexion by reducing the width of the system.

All of these embodiments result in an increased looseness of the ski, thus increasing the liveliness of the ski while retaining sufficient damping of the vibrations propagated by the structure of the ski. The embodiments in accordance with the invention can be made, for example, in such a way that the middle part has lateral recesses or a central recess.

In addition, in order to further improve the liveliness of the ski and to make the ski perform especially well on short turns and on turns in rapid succession, as is the case in special slalom, the plate of viscoelastic material located on the ski is not attached in its central area to the upper surface of the ski and/or to the lower surface of the constraining plate. In the central area, the plate has at least one oriented predeformation on the a side opposite the ski.

In a turn, the ski tends to deform by curling downward. In view of the oriented predeformation, which the plate of viscoelastic material has in its central area, the constraining plate has a tendency in turn to buckle, namely to deform upward, i.e. in the direction opposite the deformation of the ski. In this way, when the constraint exerted by the skier on the ski stops, the constraining plate favors the return of the ski to its noncurled position by spring action.

According to one embodiment the constraining plate has a predeformation defined by at least one line essentially perpendicular to the lengthwise axis of the ski.

The central area can have a predeformation resulting from the provision of one or more creases, or can have a predeformation in the form of a section with a cylindrical surface.

According to another characteristic of the invention, the maximum predeformation of the constraining plate, considered in a direction perpendicular to the upper surface of the ski, is between 0.5 and 3 mm.

Advantageously the central areas of the plate of viscoelastic material and the constraining plate include lateral recesses extending for a length of 60 to 120 mm.

The recesses made in the central area of a complex plate not only allows the complex plate to be made lighter, but also, positioning the central part between the two recesses, allows the magnitude of a return force exerted by the plate to be adjusted.

According to another embodiment of the invention, a complex constraining plate includes a first rigid plate, a second plate made of viscoelastic material, and a second rigid plate integral with one another. In this embodiment at least the upper rigid plate includes at least one outward deformation. The predeformation can be made, for example, either in only the upper rigid plate or in both the rigid plates, with the second plate of viscoelastic material in this embodiment being itself deformed since it is inserted between the two rigid plates.

Figure 2:
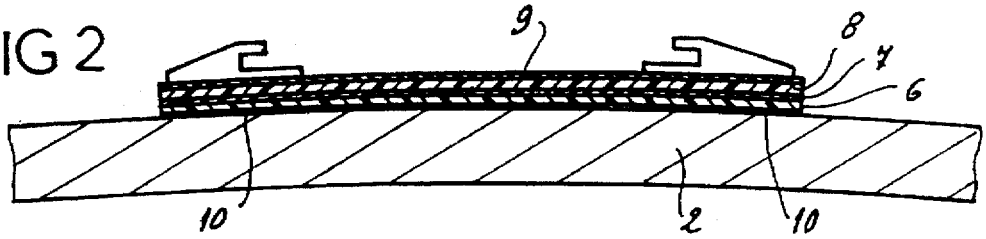
FIGS. 2 and 3 are two views in a lengthwise section and on an enlarged scale of the device in FIG. 1 in the normal position and in its arched position, respectively.

FIG. 1 shows a ski 2 on whose upper surface are mounted, in the central zone, a toe stop 3 and a heel stop 4 designed to engage in elastic fashion a boot, not shown in the drawing. Toe binding 3 and heel binding 4 are mounted on the ski with interposition of a device designated by general reference numeral 5. This device, as shown in FIG. 2, comprises a first plate 6 of viscoelastic material in contact with the upper surface of the ski, a first complex constraining plate composed of a rigid plate 7, made for example of a light metal alloy, such as an alloy with an aluminum base known by the brand name ZICRAL, a second plate 8 made of viscoelastic material, and a second rigid plate 9, also made of Zicral for example. These various plates are assembled together by glue. First plate 6 made of viscoelastic material works in shear between the complex constraining plate made up of the other plates and the ski. This first plate 6 partially eliminates the vibrations generated by the ski during use.

The second plate 8 made of viscoelastic material works in compression, with its elasticity making it possible to absorb the effects of rolling and pitching. This second place made of viscoelastic material also acts on impacts.

Figure 3:
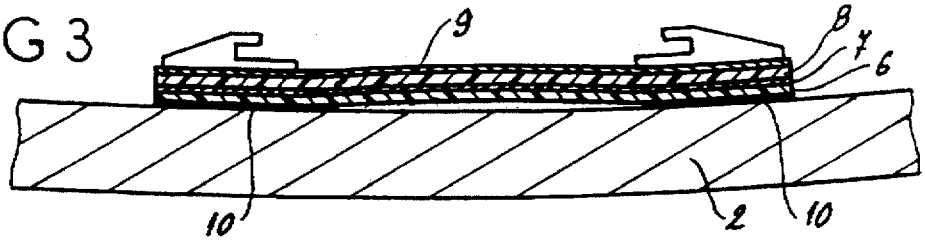

In an embodiment shown in FIGS. 2 and 3, the first plate 6 made of viscoelastic material is attached to the ski in the two end areas of the first plate, with gluing areas 10 being shown in the drawing by a dark line. Under these conditions, during arching of the ski, as shown in FIG. 3, the device obtained by assembling different parts described above, for example, has a tendency to buckle, leading to an effective elastic rebound of the ski toward its initial position.

Figure 4:
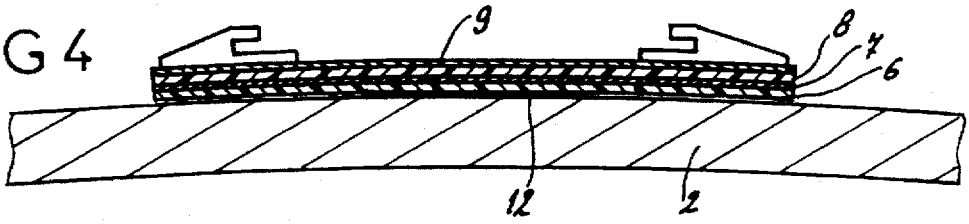
FIG. 4 is a view similar to those in FIGS. 2 and 3 showing a variation on the embodiment of this device.

In an embodiment shown in FIG. 4, the plate of viscoelastic material 6 is attached to the ski only in its central area as shown by the dark line 12 which represents the glue used for attachment. In this case the ski is free and flexes relatively freely since the plate is not attached over its entire mounting length.

Figure 5:
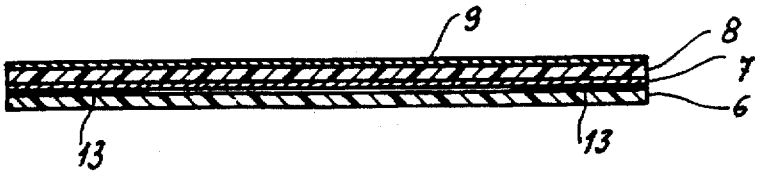
FIG. 5 is a view of the device according to the invention with partial separation of the lower plate of viscoelastic material and the first constraining plate associated with it.

In an embodiment shown in FIG. 5, the first rigid plate 7 is mounted above first plate 6 of viscoelastic material in the end areas, as shown by the dark line 13. Since the first rigid plate 7 and the first plate 6 of viscoelastic material are not joined in their central areas, there is a reduction of shear in the viscoelastic material of first plate 6, which reduces damping and promotes reactions by the ski.

Figure 6:
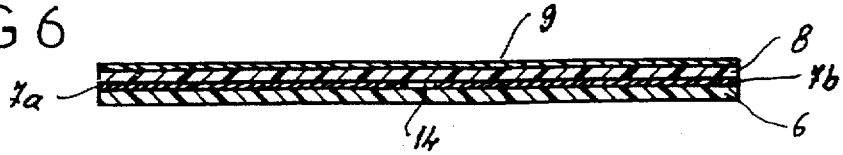
FIG. 6 is a view similar to that of FIG. 5 showing a device comprising a cut in the first constraining plate.
Figure 7:
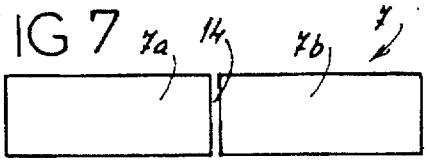
FIG. 7 is a top view of the first constraining plate of the device in FIG. 6.

In an embodiment shown in FIGS. 6 and 7, first rigid plate 7 is made in two sections 7*a* and 7*b* separated from one another, essentially at mid-length in one embodiment, by a straight slot 14 essentially perpendicular to the lengthwise axis of the ski.

Figure 8:
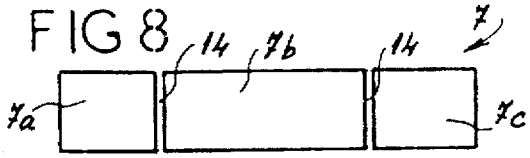
FIG. 8 to 13 show six views of a first constraining plate corresponding to embodiments of the plate in FIG. 7.

In an embodiment shown in FIG. 8 first rigid plate 7 is subdivided into three sections 7*a*, 7*b*, and 7*c* separated from one another by two straight slots 14 perpendicular to lengthwise axis of the ski.

Figure 9:
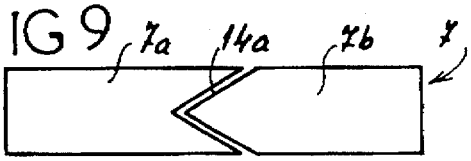

In an embodiment shown in FIG. 9 first rigid plate 7 is subdivided into two sections 7*a* and 7*b* separated from one another by a slot 14*a* in the shape of a chevron.

Figure 10:
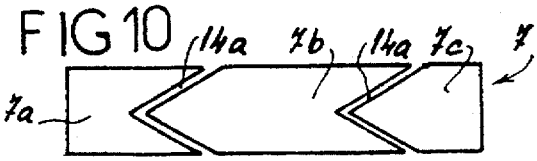

In an embodiment shown in FIG. 10 first constraining plate 7 is subdivided into three sections 7*a*, 7*b*, and 7*c* separated from one another by two slots 14*a* in the shape of a chevron.

Figure 11:
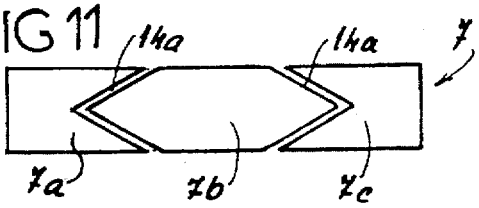

FIG. 11 is a view similar to FIG. 10 in which slots 14*a* in the shape of chevrons are reversed relative to one another.

Figure 12:
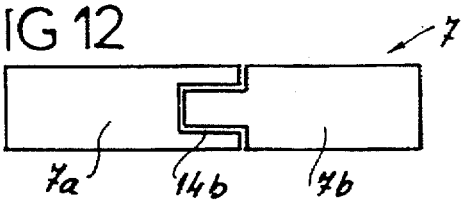

FIG. 12 shows a rigid plate 7 comprising two sections 7*a* and 7*b* separated from one another by a slot 14*b* in the shape of a broken line.

Figure 13:
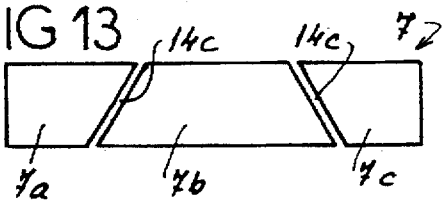

FIG. 13 shows a rigid plate 7 comprising three separate sections 7*a*, 7*b*, 7*c* separated from one another by two slanting cuts 14*c*, making the plate asymmetrical relative to the plate's lengthwise median plane.

Figure 14:
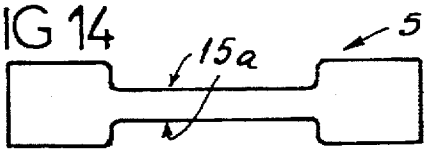
FIG. 14 and 15 two top views of assemblies according to the invention.

FIG. 14 shows a device 5 which has two lateral recesses 15*a* in its central part.

Figure 15:
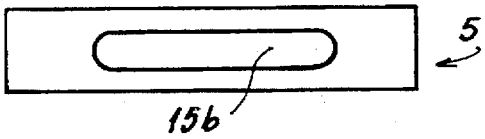

FIG. 15 shows a device 5 that has a central recess 15*b* in its central part.

Figure 16:
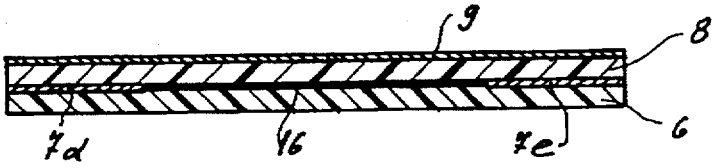
FIG. 16 and 17 are two views in lengthwise section of two other devices in which the first constraining plate does not extend over the entire length of the device.

In an embodiment shown in FIG. 16 the first rigid plate is in the form of two distinct sections 7*d* and 7*e* located in the front and rear areas, with the two plates of viscoelastic material 6 and 8 being made integral by gluing at 16 in the central area.

Figure 17:
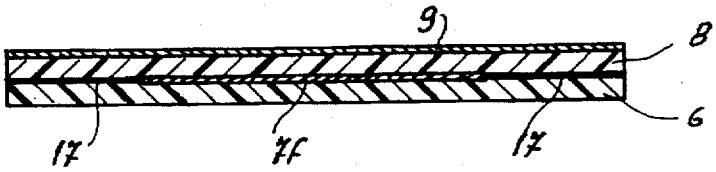

In an embodiment shown in FIG. 17, the first rigid plate 7*f* has a length less than that of plates 6 and 8 made of viscoelastic material, and it is located in the central areas of these plates, with the latter being glued directly one on top of the other at 17 in the front and rear end areas.

In a device shown in FIG. 18 to 212 a plate 18 include a first plate 19 made of viscoelastic material in contact with the upper surface of the ski. On this plate of viscoelastic material 19 there is mounted a complex constraining plate made up of a rigid plate 20 made, for example, of a light metal alloy such as an aluminum-based alloy, known by the name of ZICRAL, a second plate 22 made of viscoelastic material, and a second rigid plate 23 made of ZICRAL for example.

These various plates are assembled together by gluing. First plate 19 made of viscoelastic material works in shear between the ski and the complex constraining plate made up of plates 20, 22, and 23. This first plate 19 partially eliminates the vibrations generated by the ski during use. Second plate 22 made of viscoelastic material works in compression, with its elasticity making it possible to absorb rolling and pitching effects as well as impacts.

Complex constraining plate 18 has a central area 24 which is not attached to the upper surface of the ski. In central area 24, the two constraining plates 20 and 23 each have an outward predeformation along a transverse line 25. The two plates of viscoelastic material 19 and 22 are deformed in the same direction since they are attached to constraining plates 20 and 23. The degree of this predeformation h in the general shape of a V, oriented on the side opposite the ski, is between 0.5 and 3 mm. In addition, in area 24 the complex plate has two lateral recesses 26 extending for a length L of 60 to 120 mm. These recesses function to make the device lighter and to limit the return effect of the complex plate as discussed above.

When, starting in a normal position of the ski, as shown in FIG. 19, the ski arches as shown in FIG. 20, for example during the making of a turn, complex blade 19, 20, 22, 23 is deformed in the opposite direction at area 24 which is not attached to the ski. This oriented deformation results from the initial predeformation along line 25.

Since the complex plate contains rigid plates, for example made of ZICRAL, the rigid plate plays the role of return springs when the constraint exercised by the skier on the ski ceases. The result is an increase in the liveliness of the ski, making it perform better in a series of turns with a small radius of curvature, as is the case in special slalom.

As follows from the above, the invention results in a considerable improvement in existing technology, by providing a device for mounting a binding on a ski that makes it possible to raise the binding and damp the vibrations and impacts, while imposing little rigidity on the ski in the central zone.

As follows from the above, the invention is not limited to only the embodiments of this device described above as examples. It must be noted that certain embodiments of this device which are shown separately above could be used in combination and that the device could have neither a second plate of this viscoelastic material nor a second rigid plate. Moreover, in the case of the device shown in FIGS. 18 to 21, it could include only one layer of viscoelastic material and only one simple constraining plate made for example of a plate of Zicral, that the predeformation of central area 24 could be of a different shape, for example in a rounded form, that this central area 24 could not be hollowed out or hollowed out differently that plate 19 made of viscoelastic material could be glued to the upper surface of the ski in area 24, with constraining plate 20 in turn not being glued to the plate of viscoelastic material 19 in this same area 24, or that, in the case of a complex plate like that shown in the drawing, a predeformation could only be made in upper constraining plate 23 without thereby departing from the framework of the invention.

What is claimed is:

1. A ski having a device for mounting a boot on the ski positioned in a central zone of the ski and extending over a length substantially equal to a length needed for mounting heel and toe bindings and a boot, said device comprising:

a first viscoelastic plate comprising at least one section of viscoelastic material having an upper face and a lower face, the lower face of the first viscoelastic plate being joined with an upper surface of the ski; and a first rigid constraining plate over which bindings can be mounted, the first rigid constraining plate having an upper face and a lower face, the upper face of the first viscoelastic plate being joined with the lower face of the first rigid constraining plate, wherein the first viscoelastic plate comprises a heel area corresponding to an area over which a heel binding can be mounted, a toe area corresponding to an area over which a toe binding can be mounted, and a central area between the heel area and the toe area, and wherein the first viscoelastic plate is attached to at least one of (a) the lower surface of the first rigid constraining plate over at least part of but less than an entire length of a face of the heel area, the toe area and the central area of the first viscoelastic plate and (b) the upper surface of the ski only in the central area or only in the heel and toe areas.

2. A ski according to claim 1, wherein the lower face of the first viscoelastic plate is attached to the ski only in the heel area and the toe area.

3. A ski according to claim 1, wherein the first viscoelastic plate is attached to the ski only in the central area.

4. A ski according to claim 1, wherein the lower face of the first rigid constraining plate is attached to the first viscoelastic plate only in the heel area and the toe area.

5. A ski according to claim 1, wherein a second viscoelastic plate is joined with the first rigid constraining plate and a second rigid constraining plate is joined with the second viscoelastic plate.

6. A ski according to claim 1, wherein the first rigid constraining plate comprises a plurality of sections separated in a lengthwise direction relative to one another.

7. A ski according to claim 6, wherein each said section of the first rigid constraining plate is separated from each adjacent said section of the first rigid constraining plate by a straight slot perpendicular to a lengthwise axis of the ski.

8. A ski according to claim 6, wherein each said section of the first rigid constraining plate is separated from each adjacent said section of the first rigid constraining plate by a member selected from the group consisting of an inclined slot, a curved slot, and a broken line slot.

9. A ski according to claim 5, wherein the first rigid constraining plate has a longitudinal length less than a corresponding length of the first viscoelastic plate.

10. A ski according to claim 9, wherein the first rigid constraining plate comprises two sections, one of the two sections being located in a front area of the first viscoelastic plate and another of the two sections being located in a rear area of the first viscoelastic plate.

11. A ski according to claim 9, wherein the first rigid constraining plate extends in the central area between the first and second viscoelastic plates, the second viscoelastic plate being adhered directly on top of the first viscoelastic plate in a front end zone and a rear end zone of the viscoelastic plates.

12. A ski according to claim 1, wherein mounting areas of the first viscoelastic plate on at least one of the upper surface of the ski and the lower face of the first rigid constraining plate are asymmetrical relative to a lengthwise median plane of the ski.

13. A ski according to claim 8, wherein said plurality of sections of the first rigid constraining plate are separated from one another by slots that are asymmetrical relative to a lengthwise median plane of the ski.

14. A ski according to claim 1, further comprising recesses in a central area of the first rigid constraining plate.

15. A ski according to claim 1, wherein the lower face of the first rigid constraining plate is attached to the first viscoelastic plate only in the central area.

16. A ski having a device for mounting a boot on the ski positioned in a central zone of the ski and extending over a length substantially equal to a length needed for mounting bindings and a boot, said device comprising:

a first viscoelastic plate comprising at least one section of viscoelastic material having an upper face and a lower face, the lower face of the first viscoelastic plate being joined with an upper surface of the ski; and a first rigid constraining plate over which bindings can be mounted, the first rigid constraining plate having an upper face and a lower face, the upper face of the first viscoelastic plate being joined with the lower face of the first rigid constraining plate, wherein the first viscoelastic plate is attached over at least part of but less than an entire length of a face of the first viscoelastic plate to at least one of the upper surface of the ski and the lower surface of the first rigid constraining plate, wherein the first viscoelastic plate has a central area that is not attached to at least one of the upper surface of the ski and the lower face of the first rigid constraining plate, and the first rigid constraining plate has a central area with at least one predeformation oriented away from the ski.

17. A ski according to claim 16, wherein the predeformation is defined by at least one line essentially perpendicular to a lengthwise axis of the ski.

18. A ski according to claim 16, wherein a maximum value of the at least one predeformation of the first rigid constraining plate in a direction perpendicular to the upper surface of the ski is between 0.5 and 3 mm.

19. A ski according to claim 16 wherein the central areas of the first viscoelastic plate and of the first rigid constraining plate have lateral recesses extending for a length of 60 to 120 mm.

20. A ski according to claim 16, wherein the first rigid constraining plate is a complex plate that comprises an intermediate rigid constraining plate, a second viscoelastic plate mounted on the intermediate rigid constraining plate, and an upper rigid constraining plate mounted on the second viscoelastic plate, and at least one of the intermediate rigid constraining plate and the upper rigid constraining plate has at least one said predeformation oriented in a direction away from the ski.

21. A device for mounting bindings on a ski, comprising:

a first viscoelastic plate comprising at least one section and having an upper face and a lower face, the lower face being exposed and joinable with a ski;

a first rigid constraining plate having an upper face and a lower face, the upper face of the first viscoelastic plate being joined with the lower face of the first rigid constraining plate;

a second viscoelastic plate comprising at least one section and being joined with the upper face of the first rigid constraining plate; and a second rigid constraining plate being joined with the second viscoelastic plate; and wherein at least one of the first and second viscoelastic plates is attached over less than an entire face to at least one of the first rigid constraining plate and the second rigid constraining plate.

22. A device according to claim 21, wherein the upper face of the first viscoelastic plate is attached to at least part of but less than an entire length of the lower face of the first rigid constraining plate.

23. A device for mounting bindings on a ski, comprising:

a viscoelastic plate having a longitudinal axis and comprising at least one section and having an upper face and a lower face, the lower face being exposed and joinable with a ski; and a rigid constraining plate over which bindings can be mounted, the upper face of the viscoelastic plate being joined with the rigid constraining plate;

wherein a longitudinal length of the viscoelastic plate is greater than a corresponding length of the rigid constraining plate.

24. A device according to claim 23, wherein the rigid constraining plate comprises a plurality of sections separated in a lengthwise direction relative to one another.

25. A device according to claim 24, wherein each said section of the rigid constraining plate is separated from each adjacent said section by a member selected from the group consisting of an inclined slot, a curved slot, a straight slot and a broken line slot.

26. A device according to claim 23, further comprising at least one recess in a central area of the rigid constraining plate.

27. A device for mounting bindings on a ski, comprising:

a viscoelastic plate comprising at least one section and having an upper face and a lower face, the lower face having exposed planar sections that are joinable with a ski; and a rigid constraining plate over which bindings can be mounted, the upper face of the viscoelastic plate being joined with the rigid constraining plate;

wherein the viscoelastic plate and the rigid constraining plate have at least one predeformation that extends in a direction away from said lower face of the viscoelastic plate.

28. A device for mounting bindings on a ski, comprising:

a viscoelastic plate comprising at least one section and having an upper face and a lower face, the lower face being exposed and joinable with a ski; and a rigid constraining plate over which bindings can be mounted, the upper face of the viscoelastic plate being joined with the rigid constraining plate, wherein the viscoelastic plate is attached over at least part of but less than an entire length of said upper face to the first rigid constraining plate.

* * * * *